US007568487B2

(12) United States Patent
Simmons et al.

(10) Patent No.: US 7,568,487 B2
(45) Date of Patent: Aug. 4, 2009

(54) LID MECHANISM FOR A DRAWER-TYPE DISHWASHER

(75) Inventors: Michael C. Simmons, Moscow, TN (US); Jeffrey N. Williams, Jackson, TN (US)

(73) Assignee: Maytag Corporation, Benton Harbor, MI (US)

( * ) Notice: Subject to any disclaimer, the term of this patent is extended or adjusted under 35 U.S.C. 154(b) by 656 days.

(21) Appl. No.: 11/407,111

(22) Filed: Apr. 20, 2006

(65) Prior Publication Data

US 2007/0246083 A1 Oct. 25, 2007

(51) Int. Cl.
*B08B 3/02* (2006.01)

(52) U.S. Cl. ..... 134/25.2; 134/200

(58) Field of Classification Search ..... 134/184, 134/198, 25.2, 172, 200
See application file for complete search history.

(56) References Cited

U.S. PATENT DOCUMENTS

| | | | | | |
|---|---|---|---|---|---|
| 2,216,388 | A | * | 10/1940 | Hampel | 134/47 |
| 2,654,386 | A | * | 10/1953 | Wotring | 137/216.1 |
| 2,661,750 | A | * | 12/1953 | McNairy | 134/115 R |
| 2,667,400 | A | * | 1/1954 | Wotring | 312/331 |
| 2,668,091 | A | * | 2/1954 | Clark | 312/270.3 |
| 5,251,975 | A | * | 10/1993 | Braun et al. | 312/334.16 |
| 5,755,244 | A | | 5/1998 | Sargeant et al. | |
| 6,189,551 | B1 | | 2/2001 | Sargeant et al. | |
| 6,260,565 | B1 | | 7/2001 | Welch et al. | |
| 6,398,495 | B1 | | 6/2002 | Kazianus | |
| 6,447,081 | B1 | | 9/2002 | Sargeant et al. | |
| 6,460,555 | B1 | | 10/2002 | Tuller et al. | |
| 6,491,049 | B1 | | 12/2002 | Tuller et al. | |
| 6,571,808 | B2 | | 6/2003 | Todd | |
| 7,219,678 | B2 | * | 5/2007 | Nakano et al. | 134/183 |
| 2004/0085005 | A1 | | 5/2004 | Nakano et al. | |
| 2004/0085006 | A1 | | 5/2004 | Shinchi et al. | |

FOREIGN PATENT DOCUMENTS

| | | | |
|---|---|---|---|
| CA | 2353656 A1 | | 2/2002 |
| EP | 578862 | | 1/1994 |
| GB | 804397 A | | 11/1958 |
| JP | 2000039799 | | 2/2000 |
| JP | 2000139797 | | 5/2000 |
| JP | 2000139799 | | 5/2000 |
| JP | 2001-000377 | * | 1/2001 |
| JP | 2001046300 | | 2/2001 |
| JP | 2001046303 | | 2/2001 |

(Continued)

*Primary Examiner*—Frankie L Stinson
(74) *Attorney, Agent, or Firm*—John W. Morrison; Diederiks & Whitelaw, PLC

(57) ABSTRACT

A lid mechanism for a dishwasher having an least one washing unit provided with a lid includes at least one bracket that can be mounted to one of an outer support body and opposing side edge portions of a lid. The bracket includes a pin element that extends laterally outwardly from the bracket. The lid mechanism further includes at least one guide member that can be mounted to another of the outer support body and the opposing side edge portions of the lid. The guide member establishes a cam member and a guide track which cooperates with the pin element to raise and lower the lid relative to the washing unit. A spring is provided to biase the lid in a direction away from the washing unit.

27 Claims, 12 Drawing Sheets

FOREIGN PATENT DOCUMENTS

| | | |
|---|---|---|
| JP | 2001046304 | 2/2001 |
| JP | 2001046305 | 2/2001 |
| JP | 2001046306 | 2/2001 |
| JP | 2001061749 | 3/2001 |
| JP | 2001087200 | 4/2001 |
| JP | 2001275912 | 10/2001 |
| JP | 2001275913 | 10/2001 |
| JP | 2001275916 | 10/2001 |
| JP | 2002017642 | 1/2002 |
| JP | 2002028123 | 1/2002 |
| JP | 2002045325 | 2/2002 |
| JP | 2002065560 | 3/2002 |
| JP | 2002065570 | 3/2002 |
| JP | 2002082192 | 3/2002 |
| JP | 2002143072 | 5/2002 |
| JP | 2002165744 | 6/2002 |
| JP | 2002200026 | 7/2002 |
| JP | 2002209828 | 7/2002 |
| JP | 2002238826 | 8/2002 |
| JP | 2002291674 | 10/2002 |
| JP | 2002325714 | 11/2002 |
| JP | 2002345716 | 12/2002 |
| JP | 2002360495 | 12/2002 |
| JP | 2003000516 | 1/2003 |
| JP | 2003000517 | 1/2003 |
| JP | 2003000518 | 1/2003 |
| JP | 2003024258 | 1/2003 |
| JP | 2003038406 | 2/2003 |
| JP | 2003093309 | 4/2003 |
| JP | 2003093313 | 4/2003 |
| JP | 2003230526 | 8/2003 |
| JP | 2003310518 | 11/2003 |
| JP | 2004024907 | 1/2004 |
| JP | 2004194695 | 7/2004 |
| WO | WO 93/12706 | 7/1993 |
| WO | 98/33426 A1 | 8/1998 |

* cited by examiner

LID MECHANISM FOR A DRAWER-TYPE DISHWASHER

BACKGROUND OF THE INVENTION

1. Field of the Invention

The present invention pertains to the art of dishwashers and, more particularly, to a lid mechanism for shifting a lid of a drawer-type dishwasher between an open position and a closed position.

2. Discussion of the Prior Art

In general, dishwashers having a pull-out drawer are known in the art. In some cases, the dishwasher will include an upper, pull-out drawer forming an upper washing chamber for washing smaller objects such as glassware, utensils, small plates and the like, and a lower conventional-type dishwasher. In other cases, the dishwasher will include upper and lower pull-out washing chambers, or just simply include a single, pull-out type washing chamber. In any event, the pull-out washing chamber must be provided with a lid having a water-tight seal that prevents washing fluid from leaking out or otherwise escaping from the dishwasher during a washing operation.

Typically, the lid is pivotally mounted to the dishwasher over the washing chamber. With this arrangement, when the drawer is withdrawn from the dishwasher, a mechanism elevates the lid from the washing chamber and, when the drawer is inserted back into the dishwasher, the mechanism lowers the lid onto the washing chamber. The mechanisms employed in the prior art take on many forms. For example, many mechanisms utilize a system of springs and linkages, while others employ motors, solenoids or linear actuators to raise and lower the lid. Still other mechanisms employ a system of cams and springs to operate the lid. Each of the above-described designs is complicated, cumbersome to assemble and difficult to maintain and/or service.

Therefore, despite the existence of lid operating mechanisms in the prior art, there still exists a need in the art for an improved lid operating mechanism that shifts a lid for a drawer-type dishwasher between open and closed positions. More specifically, there exists a need for a simple, cost-effective lid operating mechanism that is easy to install, simple to maintain and still provides a consumer with reliable operation.

SUMMARY OF THE INVENTION

The present invention is directed to a lid mechanism for a dishwasher having an outer support body for slidably supporting at least one drawer-type washing unit. The washing unit or drawer includes an upper opening for receiving dishware into a washing chamber so as to be exposed to a washing operation. The lid mechanism selectively raises and lowers a lid relative to the upper opening. Preferably, the lid includes front, rear and opposing side edge portions that collectively establish an outer peripheral rim adapted to seat upon the washing unit to seal the washing chamber.

In accordance with the invention, the lid mechanism includes a pair of brackets mounted to the opposing side edge portions of the lid. Each bracket includes a pin element that extends laterally outwardly from the bracket. In addition, the lid mechanism includes various guide members that are mounted to the outer support body. Each guide member establishes a cam member and a guide track which cooperates with a respective pin element to raise and lower the lid relative to the washing chamber as the drawer is shifted into and out from the outer support body. When lowered onto the washing unit, a seal, which extends about the peripheral rim of the lid, is compressed so as to prevent washing fluid from escaping out of the washing chamber.

In further accordance with the invention, the lid mechanism includes a spring mounted in the outer support body. Actually, in accordance with a first aspect of the invention, two springs are preferably mounted to the outer support body at spaced locations and project towards the lid. In accordance with a second aspect of the invention, a spring is provided within each guide member. In any event, the spring(s) provide a biasing force that pushes the lid in a direction away from the outer support body. In accordance with the first aspect of the invention, upon shifting the washing unit into the outer support body, a rear portion of the washing unit abuts the lid, causing the lid to shift rearward in the outer support body. As the lid shifts rearward, the spring begins to compress and the pin element travels in the guide track along the cam member. Inter-engagement of the pin element and the cam member results in a downward shifting of the lid. That is, the lid is forced downward to seat upon the washing unit, thereby sealing the upper opening.

In accordance with the second aspect of the invention, the spring acts directly upon the pin element to urge the lid away from the outer support body. Conversely, upon shifting the washing unit out of the outer support body, the spring urges the lid forward, causing the pin element to travel back along the guide track resulting in an upward shifting of the lid. Thus, as the washing unit is withdrawn from the outer support body, the lid is automatically raised so as to expose the washing chamber.

Additional objects, features and advantages of the present invention will become more readily apparent from the following detailed description of preferred embodiments when taken in conjunction with the drawings wherein like reference numerals refer to corresponding parts in the several views.

DETAILED DESCRIPTION OF PREFERRED EMBODIMENTS

Figure 1:
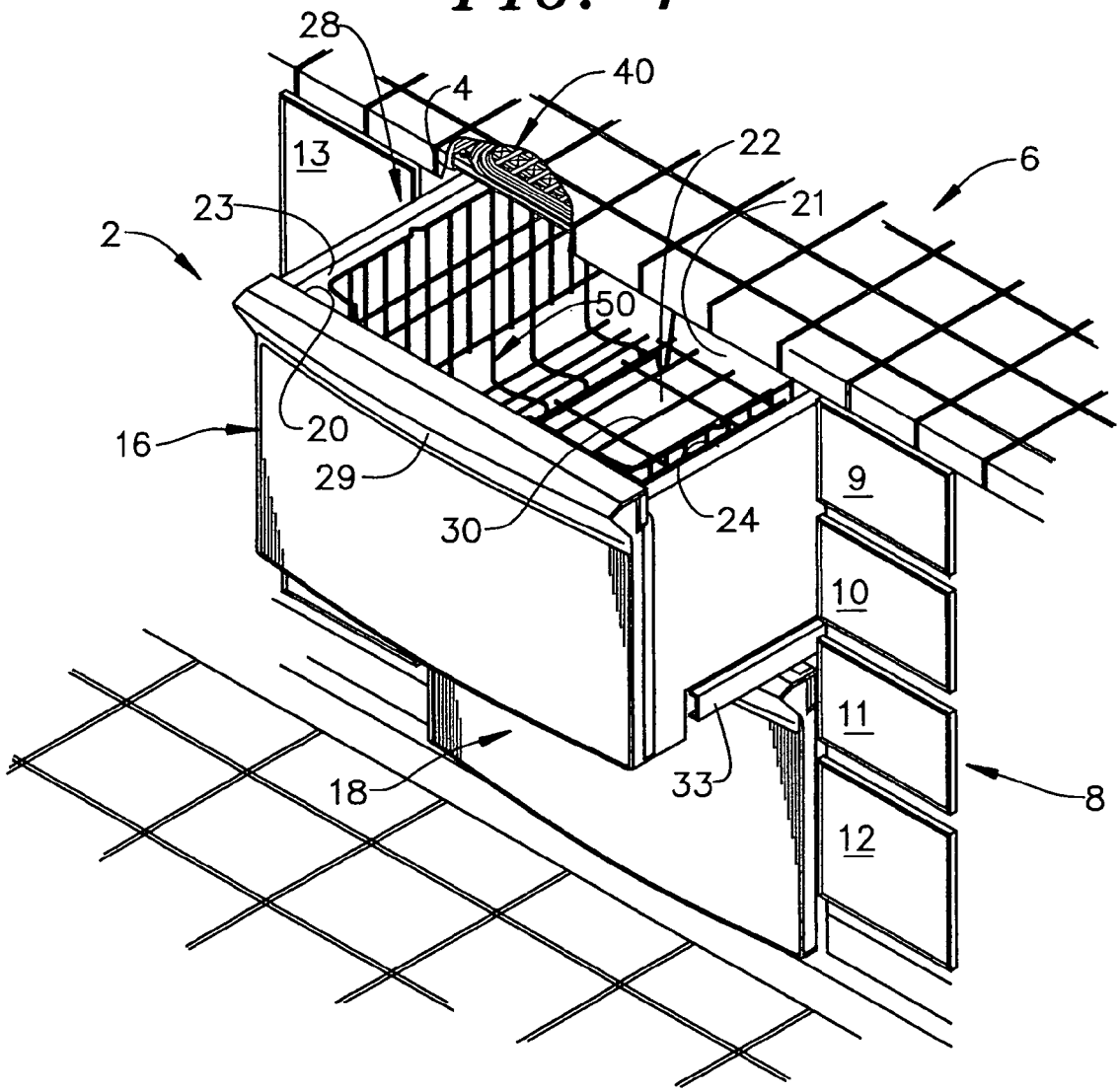
FIG. 1 is an upper right perspective view of a dishwasher incorporating a lid mechanism constructed in accordance with the present invention.

With initial reference to FIG. 1, a dishwasher constructed in accordance with the present invention is generally indicated at 2. As shown, dishwasher 2 includes an outer support body or housing 4 positioned below a kitchen countertop 6. Also below kitchen countertop 6 is shown cabinetry 8 including a plurality of drawers 9-12, as well as a cabinet door 13. Although the actual dishwasher into which the present invention may be incorporated can vary, the invention is shown in connection with dishwasher 2 depicted as a dual cavity dishwasher having an upper washing unit or drawer 16 and a lower washing unit or drawer 18. Of course, it should be understood that dishwasher 2 could simply include a single washing unit 16 or combine a slidable drawer-type washing unit with a conventional style dishwashing chamber.

In accordance with the embodiment shown, upper drawer 16 is includes a front wall 20, a rear wall 21, a bottom wall 22 and opposing side walls 23 and 24 that collectively define an upper wash chamber or tub 28. In a manner known in the art, upper drawer 16 is provided with a handle 29 for accessing tub 28. In a manner also known in the art, tub 28 includes a dish rack 30 for supporting various objects, such as glassware, utensils and the like (not shown), to be exposed to a washing operation. As will be discussed more fully below, upper drawer 16 is slidably mounted within outer housing 4 through a pair of extendible drawer support glides or rails, one of which is indicated at 33. In general, the structure described above is provided for the sake of completeness and to enable a better understanding of the overall invention which is directed to a lid mechanism 40 for drawer 16. Lid mechanism 40 selectively seals washing chamber 28 when upper drawer 16 is inserted into outer support body 4 and exposes washing chamber 28 when drawer 16 is withdrawn from outer support body 4 in a manner that will become more fully evident below.

Figure 2:
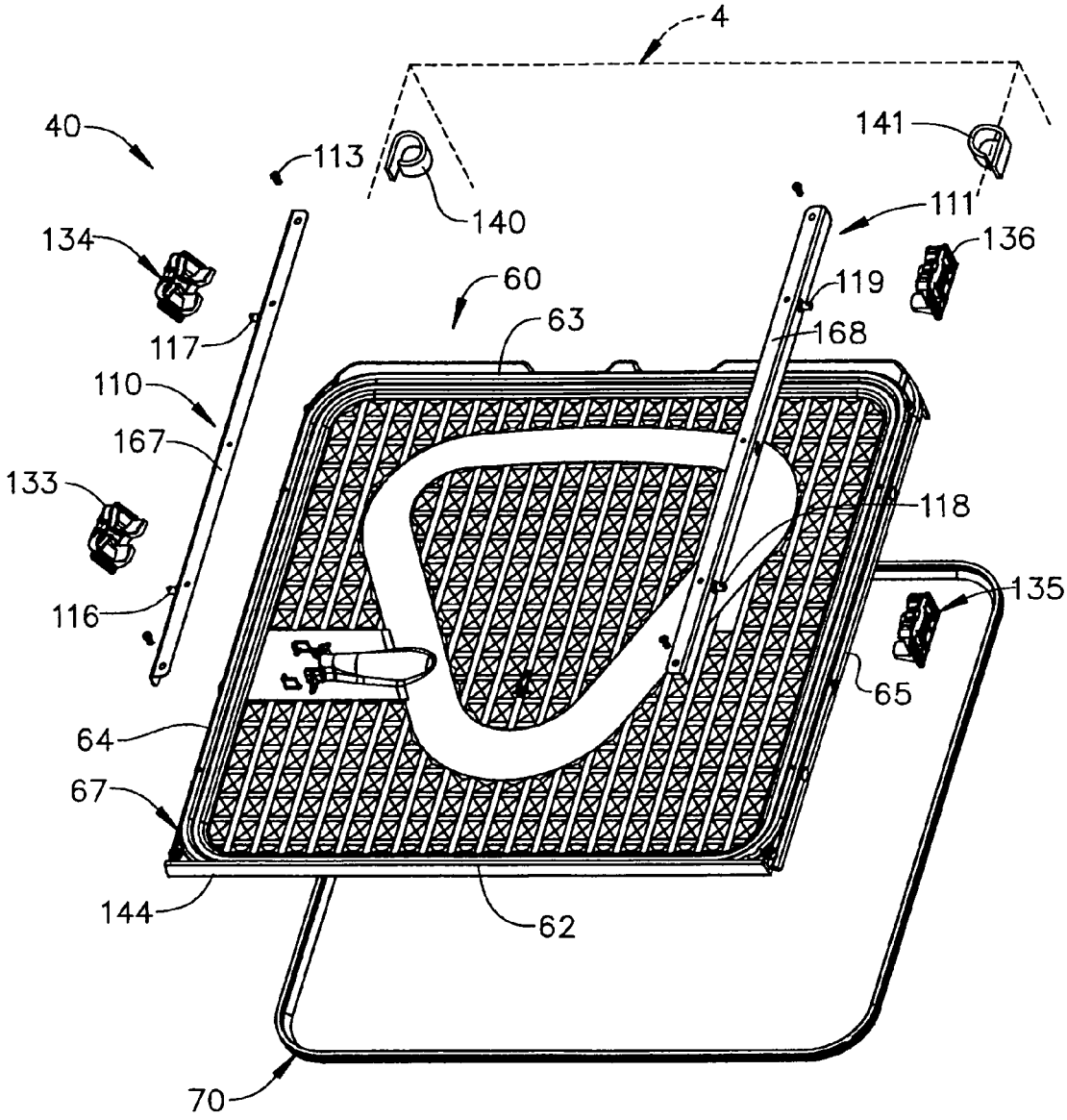
FIG. 2 is an exploded view of the lid mechanism constructed in accordance with the present invention.

As best shown in FIG. 2, lid mechanism 40 includes a lid 60 having a front edge portion 62, rear edge portion 63 and opposing side edge portions 64 and 65 that collectively define an outer, peripheral rim 67. In order to ensure washing fluid does not egress from washing chamber 28, a seal 70 is incorporated into lid 60 about peripheral rim 67. In a manner that will be described more fully below, seal 70 is adapted to be compressed between lid 60 and an upper edge portion (not separately labeled) of washing chamber 28 when drawer 16 is recessed within housing 4 and lid mechanism 40 shifts lid 60 to a lowered position.

Figure 3:
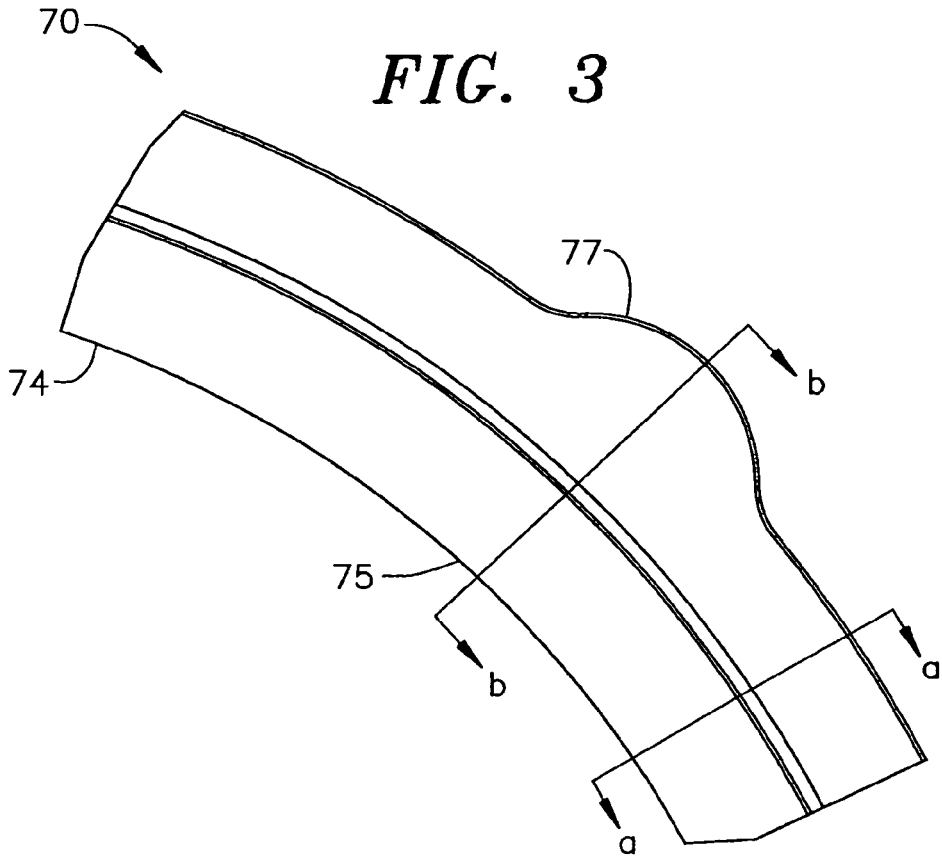
FIG. 3 is a partial, plan view of a seal employed in connection with the lid mechanism of FIG. 2.
Figure 4:
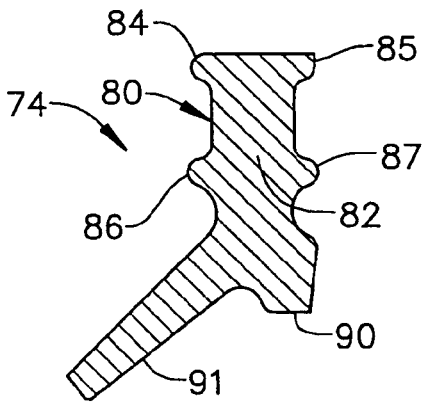
FIG. 4 is a cross-sectional side view of the seal taken along line a-a of FIG. 3.
Figure 5:
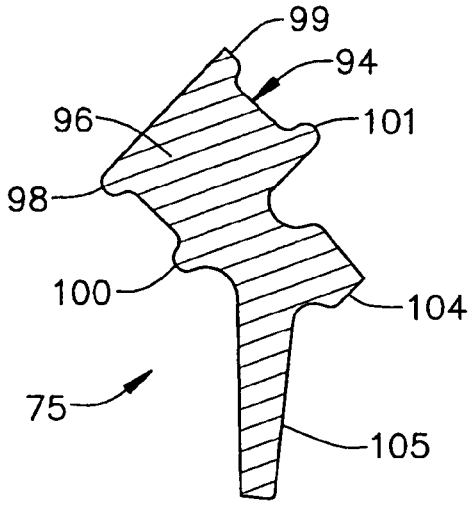
FIG. 5 is a cross-sectional side view of the seal taken along line b-b of FIG. 3.

As best shown in FIGS. 3-5, seal 70 includes a main sealing portion 74 and a corner sealing portion 75. Preferably, corner sealing portion 75 is provided with a rounded projection 77 that provides a greater sealing surface at corner portions (not separately labeled) of washing chamber 28. In any case, main sealing portion 74 includes a main portion 80 having a first cross-sectional area 82 provided with a plurality of projections 84-87 that are used to retain seal 70 within a groove (not shown) formed in lid 60, thus preventing seal 70 from inadvertently shifting. Main sealing portion 74 is also provided with a main sealing surface 90 that is adapted to engage the upper edge portion (not separately labeled) of washing chamber 28, as well as a secondary sealing surface or flange 91 that extends into washing chamber 28, with flange 91 being abutted and deflected by walls 20, 21, 23 and 24 to provide further sealing protection.

Likewise, corner sealing portion 75 includes a main corner portion 94 having a second cross-sectional area 96 which, preferably, is greater than cross-sectional area 82. Second cross-sectional area 96 is received by corresponding structure formed in lid 60 so as properly locate seal 70 on outer peripheral rim 60 during manufacturing and assembly of dishwasher 2. In any case, main corner portion 94 is provided with various projections 98-101 which further ensure seal 70 remains fixed relative to lid 60. Main corner portion 75 is also provided with a main sealing surface 104, as well as a secondary sealing surface 105 which, in a manner commensurate with that described above, prevents unnecessary egress of washing fluid from washing chamber 28 when lid 60 assumes a closed position. Actually, main sealing surface 104 is an extension of main sealing surface 90, and secondary sealing surface 105 is an extension of secondary sealing surface 91 so as to form a unified overall seal 70 for dishwasher 2.

Figure 6:
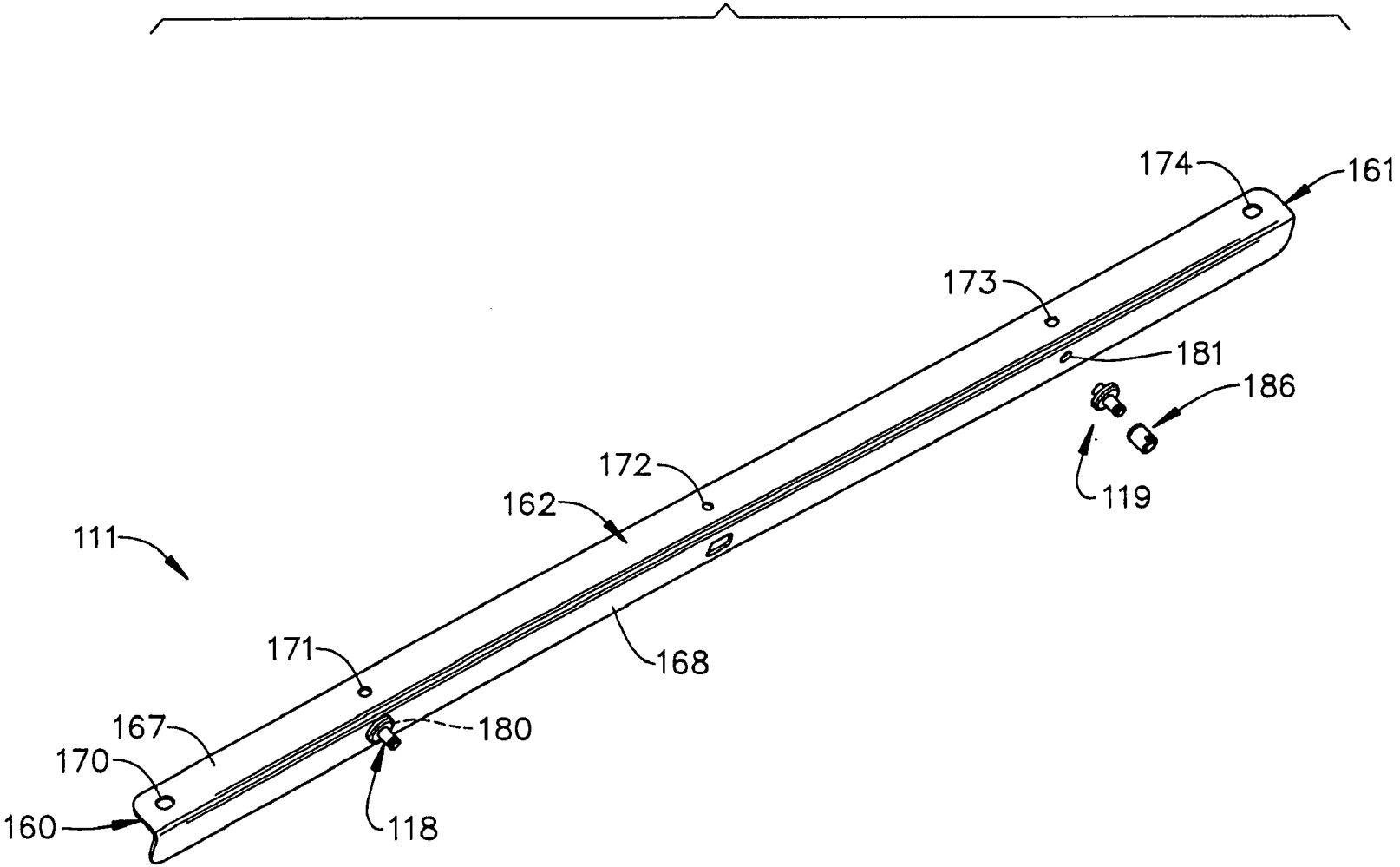
FIG. 6 is a plan view of a bracket including a pin element and roller of the lid mechanism of FIG. 2.
Figure 13:
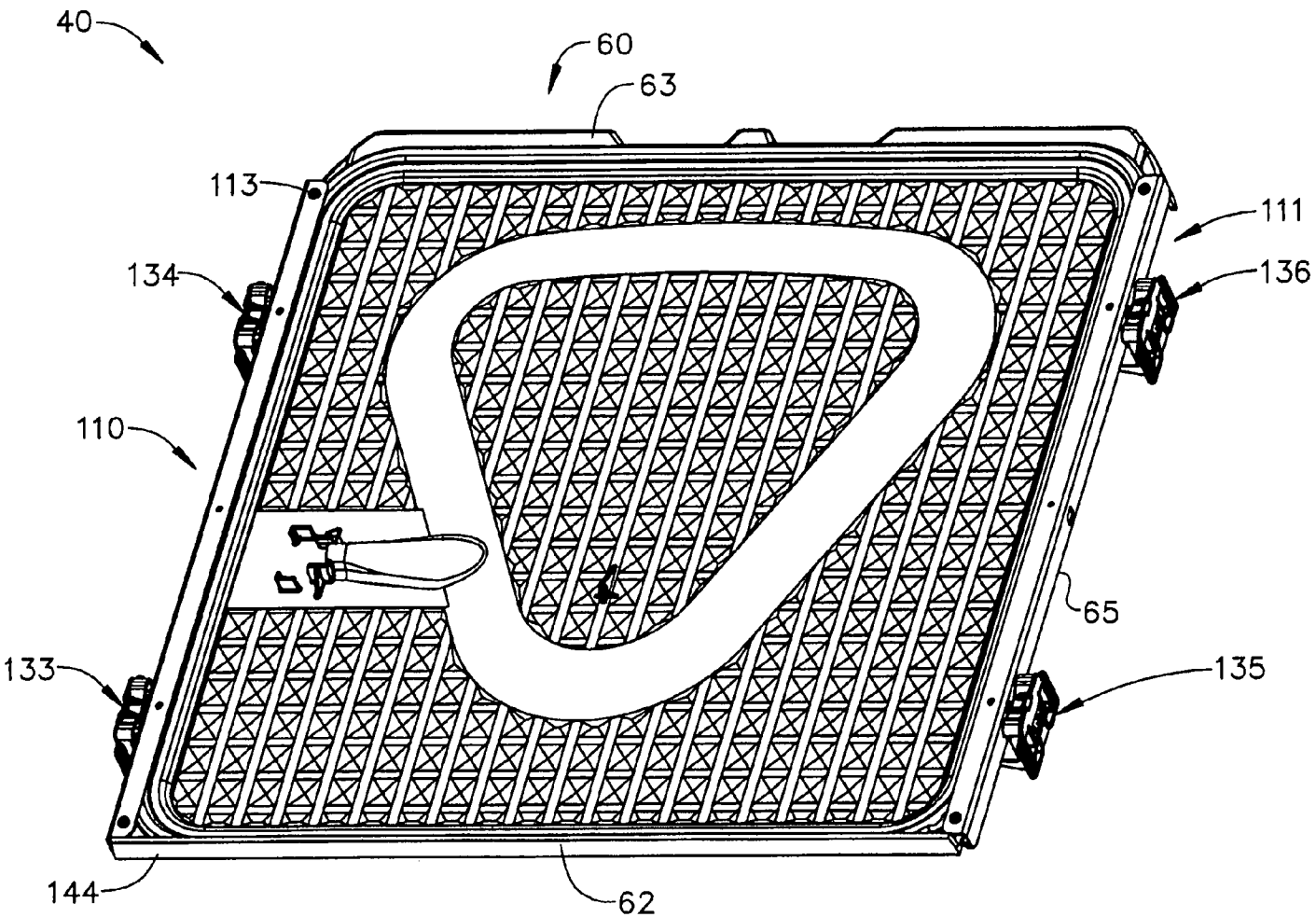
FIG. 13 is a perspective view of an upper portion of the lid mechanism of FIG. 2 shown in an assembled configuration.

Referring to FIGS. 2, 6 and 13, lid mechanism 40 further includes a pair of brackets 110 and 111 which are secured to respective opposing side portions 64 and 65 of lid 60. Brackets 110 and 111 are attached to lid 60 by a plurality of mechanical fasteners, one of which is indicated generally at 113. In accordance with the invention, each bracket 110, 111 is provided with a pair of pin elements 116, 117 and 118, 119 which inter-engage or otherwise cooperate with a plurality of guide members 133-136 to shift lid 60 between raised and lowered positions in a manner that will be more fully described below. In any event, outer support body 4 also includes a pair of springs 140 and 141 which are configured to force lid 40 forward in outer support body 4 when drawer 16 is shifted outward. Springs 140, 141 are preferably mounted to rear sections (not separately labeled) of each opposing side wall of outer support body 4 as shown in FIG. 2. Furthermore, lid mechanism 40 includes a front brace or stiffener 144 that extends across and is secured to front edge portion 62 of lid 60. Stiffener 144 ensures that lid 60 remains flat and, over time, does not twist or become warped.

Reference will now be made to FIG. 6 in describing the particular structure of brackets 110 and 111. However, as each bracket 110, 111 is constructed similarly, a detailed description will be made with respect to bracket 111 with an understanding that bracket 110 has corresponding structure. As shown, bracket 111 includes a first end portion 160 that extends to a second end portion 161 through an intermediate portion 162. Actually, bracket 111 is L-shaped in cross-section so as to establish a top surface portion 167 which is fastened along a top edge portion (not separately labeled) of lid 60 (also see FIG. 13) and a side surface portion 168 which extends along side edge portion 65. Towards that end, bracket 111 is provided with a first plurality of apertures 170-174 formed in top surface portion 167, as well as a second plurality of apertures 180-181 formed in side surface portion 168. First plurality of apertures 170-174 receive mechanical fasteners 113 to secure bracket 111 in place, while apertures 180 and 181 are positioned so as to receive pin elements 118 and 119. Although pin element 119 and roller 186 will be discussed further below, FIG. 6 shows pin element 119 including a roller 186 designed to facilitate a smooth transition as lid 60 shifts between raised and lowered positions. Of course, it should be understood that, while only one roller 186 is illustrated in connection with the present invention, each pin element 116-119 is provided with a respective roller 186.

Figure 7:
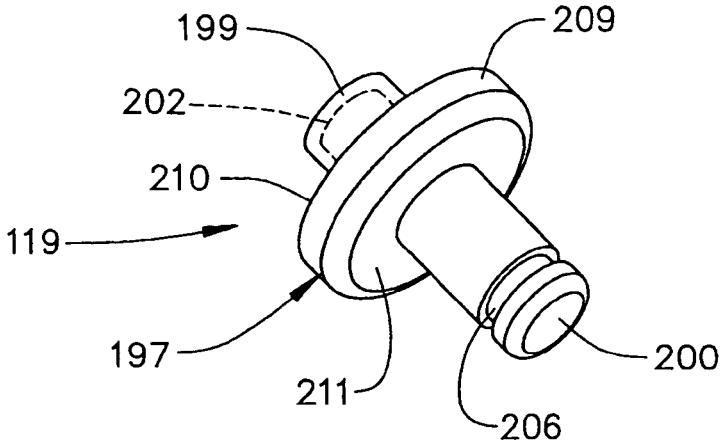
FIG. 7 is a detail view of the pin element of FIG. 6.

Reference will now be made to FIG. 7 in describing details of pin elements. Given that each pin element 116-119 is constructed similarly, a detailed description will be made with respect to pin element 119 with an understanding that the remaining pin elements, i.e., pin elements 116-118, are similarly formed. As shown, pin element 119 includes a main body portion 197 having a first end 199 and a second end 200. First end 199 is provided with a central bore 202. When pin element 119 is inserted into aperture 181, first end 199 is riveted or hammered with a rivet tool to form a mushroomed end section (not shown) that engages with bracket 111. On the other side, second end portion 200 is provided with a recessed portion or radial groove 206 which, in a manner that will described more fully below, snap-fittingly receives roller 186. As illustrated in FIG. 7, main body portion 197 is generally disk-shaped having an outer edge 209, an inner surface 210 and an outer surface 211. When pin element 119 is inserted into aperture 181, inner surface 211 abuts side surface portion 168 thereby ensuring that pin element 119 projects a particular distance from side surface portion 168 of bracket 111. Actually, the particular design of main body portion 197 ensures that pin element 119 extends laterally outward from bracket 111 at a substantially perpendicular angle, while simultaneously providing structural support for cantilevered second end portion 200.

Figure 8:
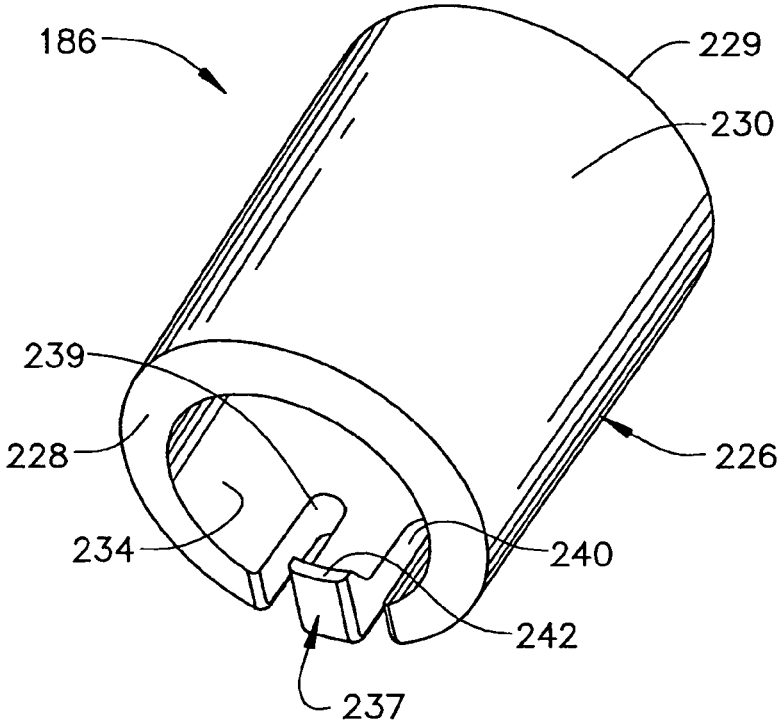
FIG. 8 is a perspective view of the roller of FIG. 6.
Figure 9:
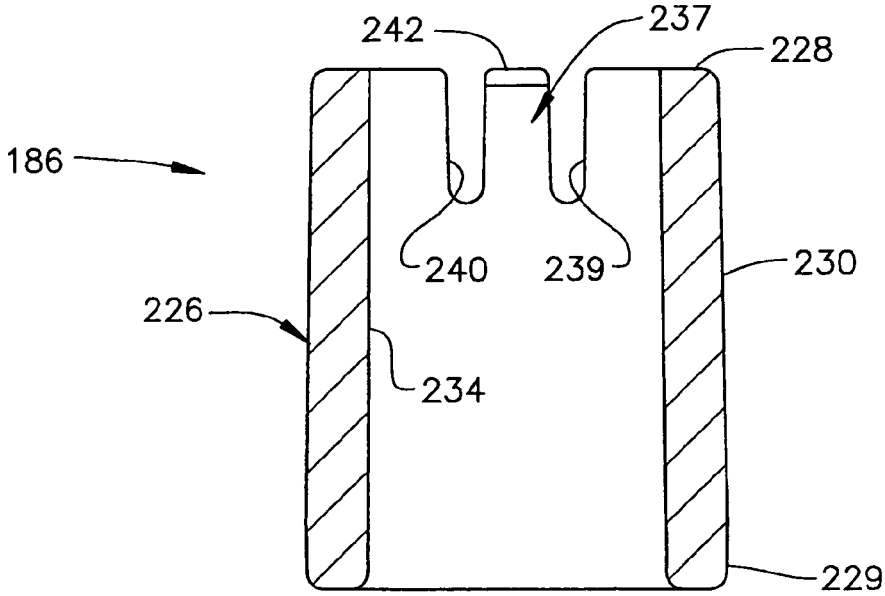
FIG. 9 is a cross-sectional view of the roller of FIG. 8.

Referring now to FIGS. 8 and 9, roller 186 is shown to include a main portion 226 having a first end section 228, a second end section 229 and an intermediate or rolling surface 230. In accordance with the invention, roller 186 includes a hollow interior portion 234 exposed at first end portion 228. Hollow interior portion 234 is designed to receive second end 200 of a respective pin element 116-119 and is actually slightly tapered in accordance with the invention. In further accordance with the invention, roller 186 is provided with a snap element 237 which is established by the incorporation of two slotted openings 239 and 240 formed at first end section 228. Snap element 237 includes a hook portion 242 that, when roller 186 is positioned upon pin element 119, engages or snaps into radial groove 206 so as to retain roller 186 relative to pin element 119.

Figure 10:
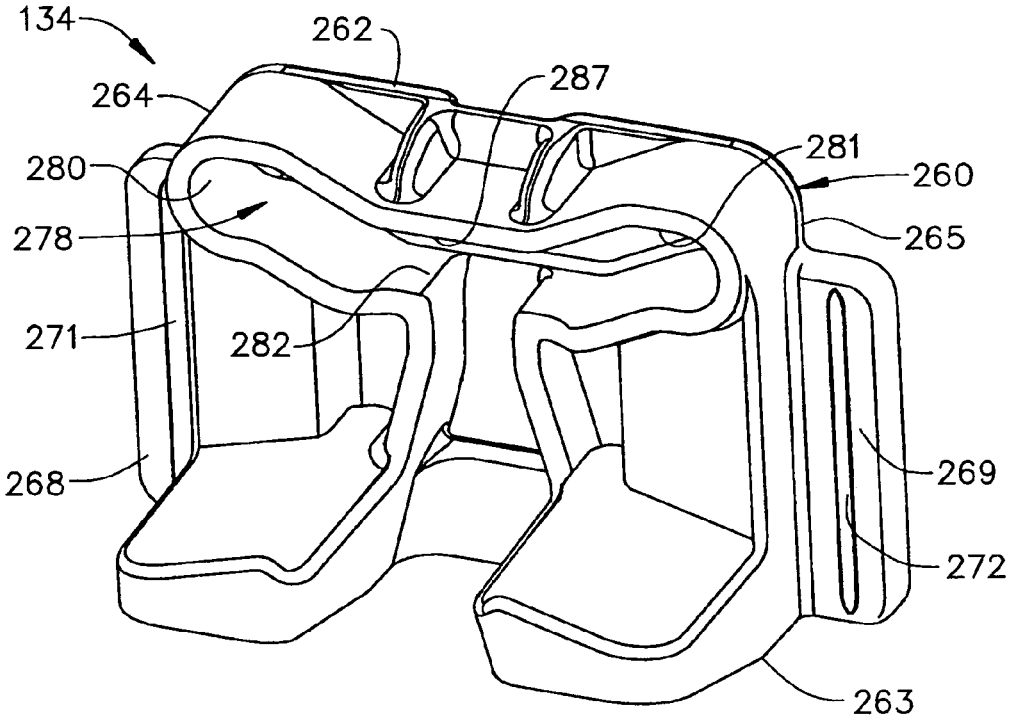
FIG. 10 is a perspective view of a guide member portion of the lid mechanism of FIG. 2.
Figure 11:
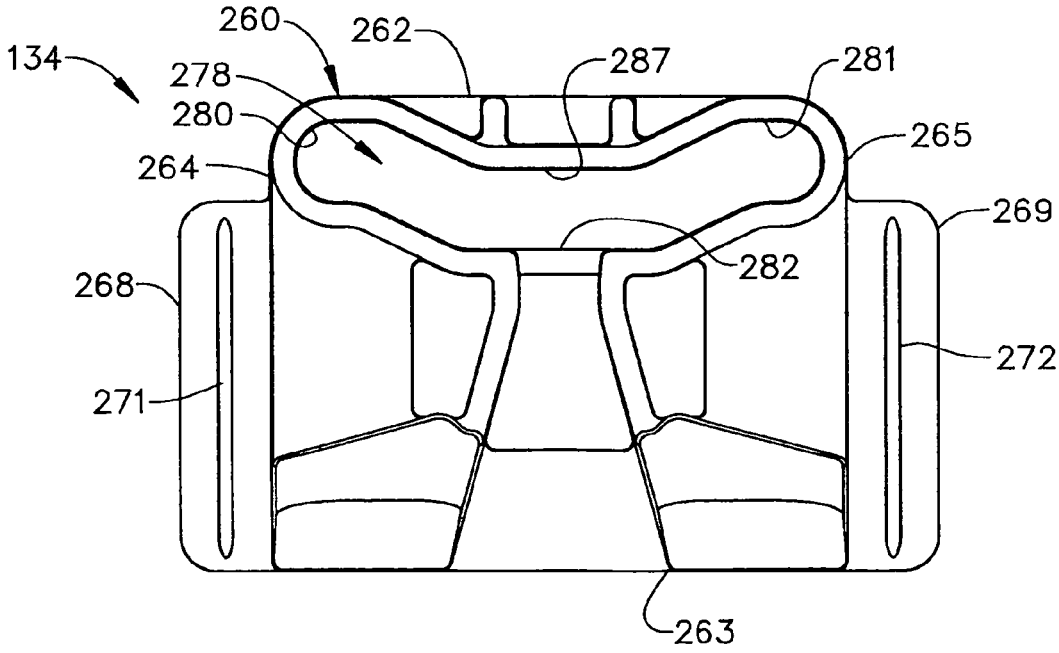
FIG. 11 is a front elevational view of the guide member of FIG. 10.
Figure 12:
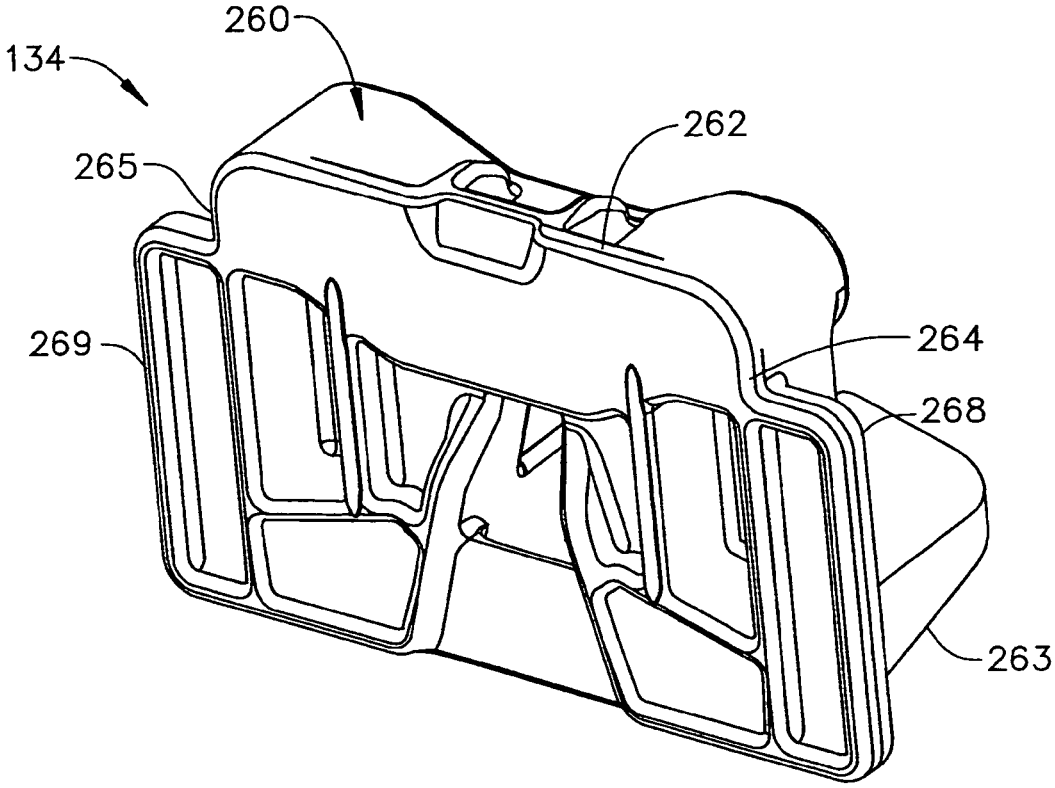
FIG. 12 is a upper, right rear perspective view of the guide member of FIG. 10.
Figure 14:
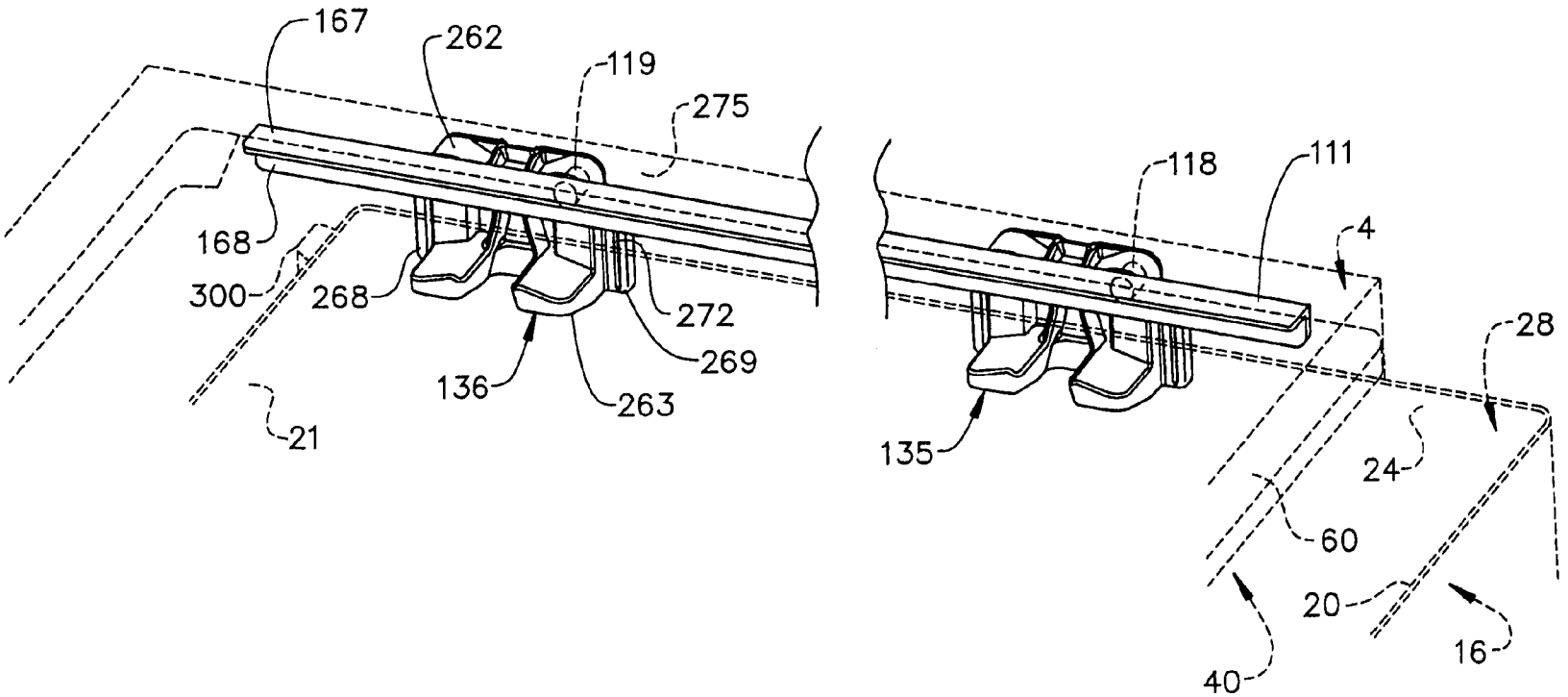
FIG. 14 is a perspective view of the dishwasher illustrating the lid mechanism with the lid in a raised position.

Reference will now be made to FIGS. 10-12 in describing guide members 133-136 constructed in accordance with the present invention. As each guide member 133-136 is similarly constructed, a detailed description will be made with reference to guide member 134 with an understanding that guide members 133 and 135-136 are identically formed. In accordance with the invention, guide member 134 includes a main body portion 260 having an upper portion 262, a bottom portion 263 and opposing side portions 264 and 265. Each opposing side portion 264, 265 is provided with a corresponding flange member 268, 269 having formed thereon an associated rib 271, 272. Guide member 134 can be simply fixed to outer support body 4. However, in one preferred embodiment of the invention, guide member 134 is mounted for vertical shifting movement relative to side wall 275 (FIG. 14). More specifically, flange members 268 and 269 extend into slots (not shown) formed in side wall 275 to position guide member 134 fore-to-aft along side wall 275, while permitting a limited amount of relative vertical shifting. In this manner, flange members 268 and 269 enable guide member to slide or shift relative to outer support body 4 as lid 60 transitions between raised and lowered positions. At the same time, ribs 271 and 272 allow guide member 134 to shift relative to outer support body 4 without cocking and potentially becoming misaligned or jammed.

In any case, guide member 134 is provided with a curvilinear guide track 278 that receives pin element 119. Preferably, guide track 278 includes a first end portion 280, a second end portion 281 and an intermediate portion 282, with first and second end portions 280 and 281 being vertically offset from, i.e., positioned above, intermediate portion 282. Actually, while guide track 278 extends to first and second end portions 280 and 281, only one end portion is employed depending on which side wall 275 of outer support body 4 guide track 278 is mounted. Therefore, this preferred construction allows a single guide member to be employed in connection with either side of washing chamber 28. In accordance with the most preferred form of the invention, guide member 134 includes a cam member 287 provided at intermediate portion 282 of guide track 278. Cam member 287 is generally trapezoidal in cross-section so as to force pin element 119 and, consequently, lid member 60 downward upon washing chamber 28 when drawer 16 is inserted into outer housing 4 in a manner that will be described more fully below.

Figure 15:
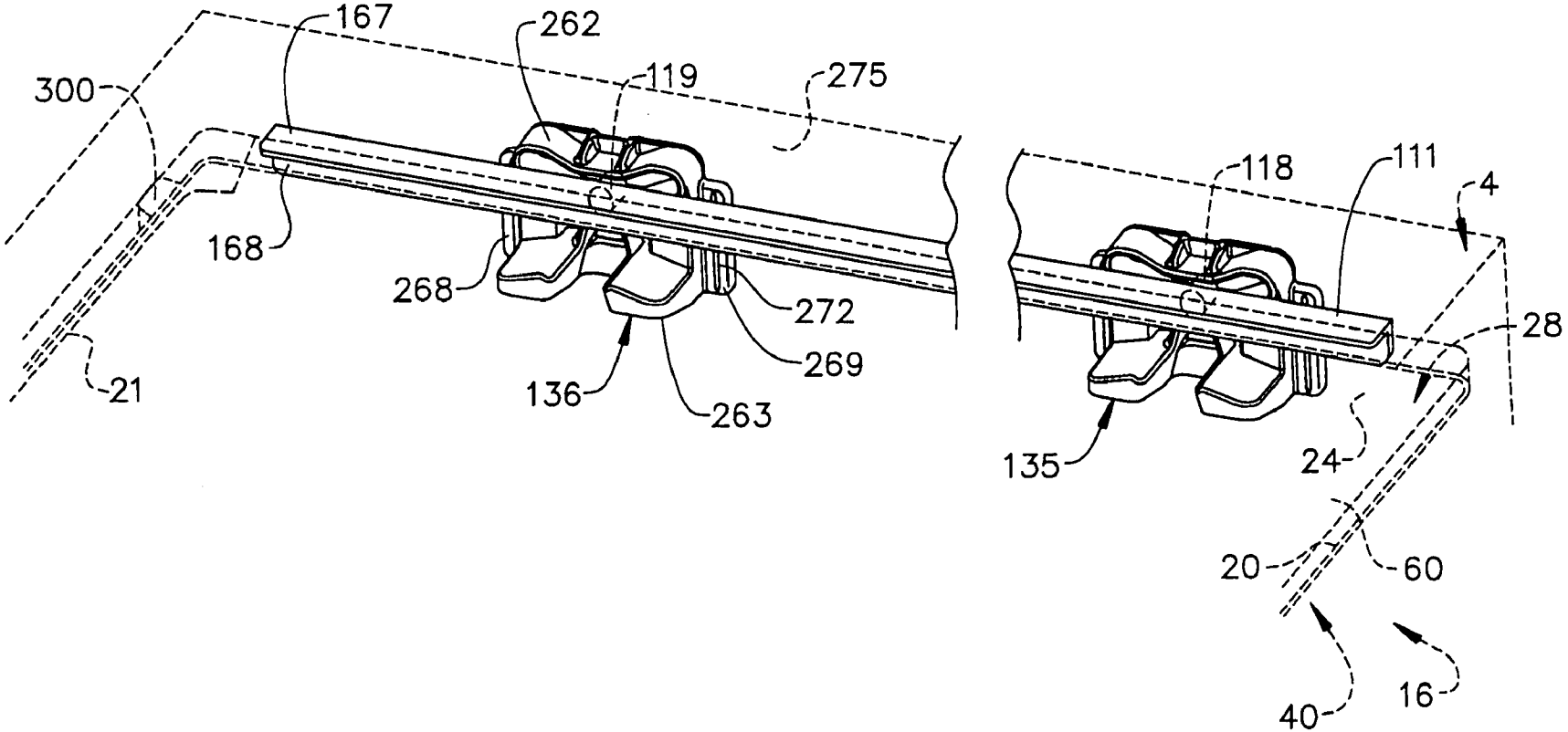
FIG. 15 is a perspective view of the dishwasher illustrating the lid mechanism with the lid in a lowered position.

Having described a preferred structure of lid mechanism 40, reference will now be made to FIGS. 14 and 15 in describing a preferred method of operation. As best shown in FIG. 14, upon shifting drawer 16 out from outer body 4, springs 140 and 141 (FIG. 2) push lid 60 forward, causing pin elements 118 and 119 to transition along guide track 278 from intermediate portion 282 towards second end portion 281. Given that second end portion 281 is positioned at a height above intermediate portion 282, lid 60 is caused to elevate relative to washing chamber 28. Correspondingly, when drawer 16 is inserted into outer body 4, as shown in FIG. 15, a rear portion of drawer 16 engages lid 60 through, for example, a bumper 300, forcing pins 118 and 119 to transition back along guide track 278 towards intermediate portion 282. As lid 60 is forced inward or to a retracted position relative to outer support body 4, springs 140 and 141 become compressed against a rear portion of outer support body 4 and pin elements 118 and 119 engage, through a respective roller 186, with cam member 287 which, as best shown in FIG. 11, is positioned at a level below second end portion 281 thereby causing lid 60 to shift downward and seal upon washing chamber 28.

Figure 16:
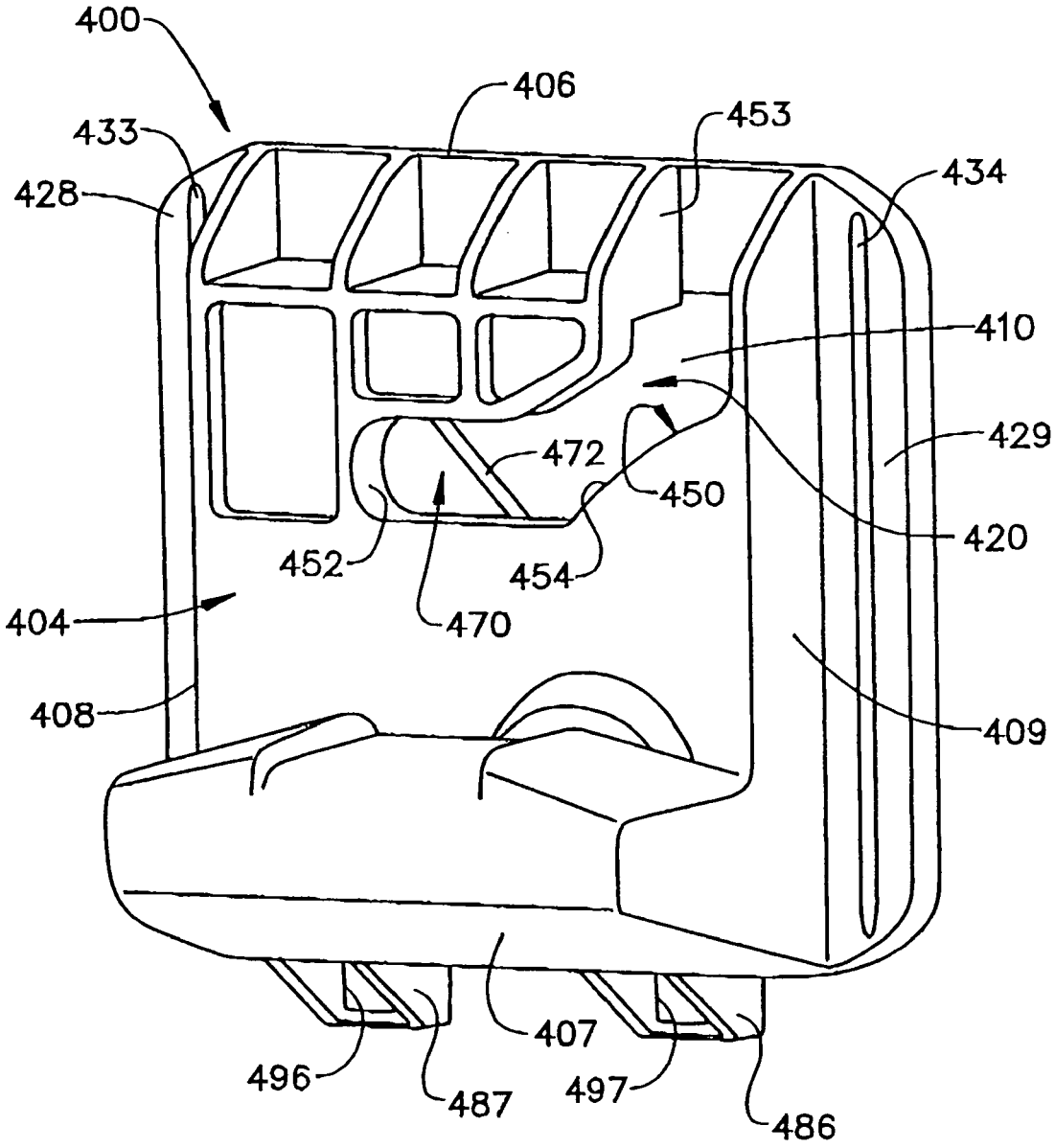
FIG. 16 is a perspective view of a guide member constructed in accordance with another embodiment of the present invention.
Figure 17:
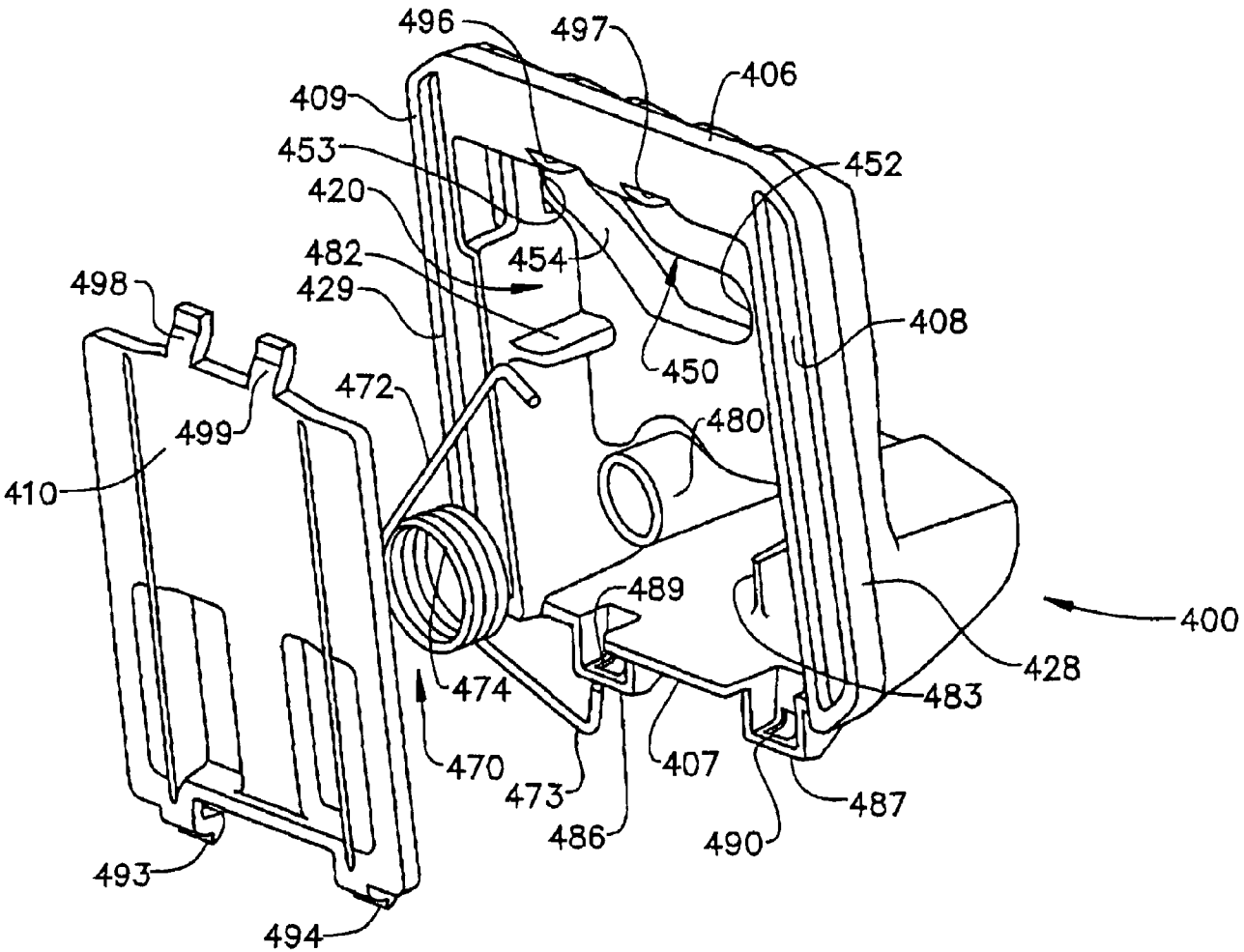
FIG. 17 is a rear, perspective, exploded view of the guide member of FIG. 16.

Reference will now be made to FIGS. 16 and 17 in describing a guide member 400 constructed in accordance with a second embodiment of the present invention. As shown, guide member 400 includes a main body portion 404 having an upper portion 406, a bottom portion 407, opposing side portions 408 and 409, and a rear portion 410 that collectively define a central, internal cavity 420. Each opposing side portion 408, 409 is provided with a corresponding flange member 428, 429 having formed thereon an associated rib 433, 434. In a manner similar to that described above with respect to guide member 134, guide member 400 can be simply fixed to outer support body 4. However, guide member 400 is preferably mounted for vertical shifting movement relative to side wall 275. More specifically, flange members 428 and 429 extend into slots (not shown) formed in side wall 275 to position guide member 400 along side wall 275, while permitting a limited amount of relative vertical shifting. In this manner, flange members 428 and 429 enable guide member 400 to slide or shift relative to outer support body 4 as lid 60 transitions between raised and lowered positions. At the same time, ribs 433 and 434 ensure that guide member 400 shifts relative to outer support body 4 without cocking and/or potentially becoming misaligned.

In a manner also similar to that described above, guide member 400 is provided with a curvilinear guide track 450 that it is sized so as to slidingly receive pin element 119. In accordance with the embodiment shown, guide track 450 includes a first end portion 452, a second end portion 453 and an intermediate, angled portion 454 that collectively define an opening which extends into central cavity 420. Also in accordance with the embodiment shown, second end 453 is exposed at upper portion 406 at a position adjacent side portion 409. This particular construction allows pin element 119 to shift out from guide track 450, allowing lid 60 to transition from the lowered position to the raised position.

In further accordance with the embodiment shown, guide member 400 includes a spring 470 positioned within central cavity 420. As best shown in FIG. 17, spring 470 includes a first leg member 472, a second leg member 473 and an intermediate or coil portion 474. Spring 470 is positioned within central cavity 420 with coil member 474 encircling a cylindrical base member 480 formed within central cavity 420 adjacent bottom portion 407. In order to properly position spring 470 within central cavity 420, a first guide member 482 is formed on, and projects laterally outward from, side portion 409 and a second guide member 483 is formed on, and extends laterally outward from, bottom portion 407. First and second guide members 482 and 483 position respective ones of first and second leg members 472 and 473 of spring 470. More specifically, first guide member 482 positions first leg member 472 so as to extend across a portion of guide track 450.

In any event, spring 470 is enclosed within central cavity 420 by rear portion 410. Towards that end, main body portion 404 includes a pair of hinge members 486 and 487 formed at bottom portion 407. Each hinge member 486, 487 includes a corresponding opening 489, 490 adapted to receive a corresponding one of first and second hinge elements 493 and 494 that project outward from a lower edge portion (not separately labeled) of rear portion 410. Main body portion 404 also includes a pair of clip members 496 and 497 formed at upper portion 406. Clip members 496 and 497 are adapted to snap-fittingly receive corresponding clip elements 498 and 499 formed on an upper edge portion (not separately labeled) of rear portion 410. With this arrangement, rear portion 410 can be readily attached to main body portion 404 and selectively removed to access spring 470 as needed.

Having described a preferred construction of guide member 400, a preferred method of operation will now be set forth. As described above, guide member 400 is mounted to side wall 275 of outer support body 4. However, given the particular orientation of guide track 450, a corresponding guide member (not shown) having a guide track that extends in an opposite direction, i.e., the guide track opens at top portion 406 adjacent side portion 408, is provided on the opposing side wall of outer support body 4. In any event, upon shifting drawer 16 out from outer body 4, spring 470, more particularly first leg member 472 of spring 470, urges pin element 119 towards intermediate or angled portion 454 of guide track 450. As drawer 16 continues to shift outward from outer support body 4, pin element 119 shifts into second end portion 453 and subsequently out second end 453 of guide track 450, allowing lid 60 to transition to the raised position. Correspondingly, when drawer 16 is inserted into outer body 4, a rear portion of drawer 16 engages lid 60 through, for example, bumper 300 (FIG. 14) to force pin element 119 to transition back along guide track 450 towards first end portion 452. As lid 60 shifts farther inward, first leg member 472 of spring 470 becomes compressed ensuring that lid 60 is raised upon a subsequent opening operation.

Although described with reference to preferred embodiments of the invention, it should be readily understood that various changes and/or modifications can be made to the invention without departing from the spirit thereof. For example, while described with the guide elements mounted to the outer support body and the pin elements mounted to the lid, it should be recognized that the location of these elements could also be reversed, with the guide elements mounted to the lid and the pin elements mounted to the outer support body. Furthermore, while shown mounted to the outer support body and in the guide elements, the springs could also be mounted to the lid. In general, the invention is only intended to be limited by the scope of the following claims.

We claim:

1. A dishwasher comprising:

an outer support body;

a washing unit slidably supported in the outer support body, said washing unit including front, rear, bottom and opposing side walls that collectively define a washing chamber having an upper opening;

a lid mounted for movement relative to the outer support body for selectively sealing the upper opening, said lid including front, rear and opposing side edge portions;

at least one bracket mounted to one of the outer support body and the lid;

a pin element extending laterally from the at least one bracket;

at least one guide member mounted to another of the outer support body and the lid, said at least one guide member including a guide track; and a spring mounted in the outer support body wherein, upon shifting the washing unit into the outer support body, said washing unit abuts the lid, shifting the lid rearward and causing the spring to compress and the pin element to travel in the guide track resulting in a downward shifting of the lid and the lid seating against the upper opening and, upon shifting the washing unit out from the outer support body, said spring urges the lid forward, causing the pin element to travel along the guide track resulting in an upward shifting of the lid from upon the washing unit.

2. The dishwasher according to claim 1, wherein the at least one guide member is slidably attached to the outer support body.

3. The dishwasher according to claim 1, wherein the at least one bracket includes first and second brackets mounted to respective ones of the opposing side edge portions of the lid.

4. The dishwasher according to claim 3, wherein each of the first and second brackets includes two said pin elements.

5. The dishwasher according to claim 4, wherein each of the pin elements includes a radial groove.

6. The dishwasher according to claim 5, further comprising: a roller attached to each of the pin elements.

7. The dishwasher according to claim 6, wherein the roller includes a hook, said hook being adapted to engage with the radial groove to snap-fittingly mate with the pin element.

8. The dishwasher according to claim 4, wherein the outer support body includes opposing side walls and the at least one guide member includes four guide members, with two of the four guide members being mounted to each of the opposing side walls.

9. The dishwasher according to claim 1, further comprising: at least one stiffening member mounted to the front edge portion of the lid.

10. The dishwasher according to claim 1, wherein the guide track includes a cam member, said pin element cooperating with the cam member to shift the lid vertically relative to the washing unit.

11. The dishwasher according to claim 10, wherein the at least one guide member is fixed to the outer support body and said pin element extends from the lid.

12. The dishwasher according to claim 1, further comprising: another spring, said spring and said another spring being mounted to an inner rear section of the outer support body.

13. The dishwasher according to claim 1, wherein the guide track includes a first end portion, a second end portion and an intermediate portion, said cam member being formed in the intermediate portion.

14. The dishwasher according to claim 13, wherein the pin element transitions between only one of the first and second end portions and the intermediate portion to shift the lid relative to the washing unit.

15. The dishwasher according to claim 13, wherein the first and second end portions of the guide track are offset relative to the cam member.

16. The dishwasher according to claim 1, further comprising: a seal mounted to an outer peripheral portion of the lid, said seal including a main sealing portion having a first cross-sectional area and a corner sealing portion having a second cross-sectional area.

17. The dishwasher according to claim 16, wherein the second cross-sectional area is greater than the first cross-sectional area.

18. The dishwasher according to claim 1, wherein the at least one pin element includes a main body portion having a first end and a second end, said first end being provided with a bore adapted to receive a mechanical fastener to secure the at least one pin element to the at least one bracket.

19. The dishwasher according to claim 1, wherein the guide member includes a top portion, bottom portion, rear portion and opposing side portions that collectively define a central cavity.

20. The dishwasher according to claim 19, wherein the guide track is defined by a slot that opens to the central cavity.

21. The dishwasher according to claim 20, wherein the spring is positioned within the central cavity, said spring including a leg member that extends across the guide track.

22. The dishwasher according to claim 19, wherein the rear portion is detachably mounted to the guide member.

23. A method of sealing a washing chamber of a dishwasher drawer slidably mounted in an outer support body comprising:

shifting the washing chamber into an outer support body;

abutting a lid with the washing chamber;

moving the lid rearward into the outer support body with continued shifting of the washing chamber;

compressing a spring provided in the outer support body with continued movement of the lid; and guiding a pin element, extending from one of the outer support body and the lid, within a guide track and along a cam member formed in a guide member mounted to another of the outer support body and the lid resulting in a downward shifting of the lid so as to seal about an upper opening of the washing chamber.

24. The method of claim 23, wherein guiding the pin within the guide track includes causing a roller, snap-fittingly mounted to the pin element, to transition between an end portion of the guide track and the cam member.

25. The method of claim 23, further comprising: shifting the guide member relative to the outer support body as the pin element is guided within the guide track.

26. The method of claim 23, wherein guiding the pin element in the guide track compresses the spring.

27. The method of claim 23, wherein the lid directly abuts and compresses the spring.

* * * * *